US006464522B2

(12) United States Patent
Osawa et al.

(10) Patent No.: US 6,464,522 B2
(45) Date of Patent: Oct. 15, 2002

(54) CONNECTOR WITH TERMINAL PROTECTIVE PLATE HAVING INTERNAL AND EXTERNAL SEALING MEMBERS

(75) Inventors: Hiroki Osawa; Hajime Kawase; Ryotaro Ishikawa; Yuuichi Nankou; Kozue Takatsuki, all of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/840,933

(22) Filed: Apr. 25, 2001

(65) Prior Publication Data

US 2001/0039144 A1 Nov. 8, 2001

(30) Foreign Application Priority Data

Apr. 25, 2000 (JP) ..... 2000-124159
Oct. 4, 2000 (JP) ..... 2000-305072

(51) Int. Cl.[7] ..... H01R 13/52; H01R 13/44
(52) U.S. Cl. ..... 439/271; 439/135
(58) Field of Search ..... 439/135, 136, 439/137, 138, 139, 140, 278, 587, 589, 271, 157

(56) References Cited

U.S. PATENT DOCUMENTS 4,832,613 A * 5/1989 Tsukakoshi ..... 439/141
5,975,929 A * 11/1999 Matsuura et al. ..... 439/157

FOREIGN PATENT DOCUMENTS

JP 11-204184 7/1999

* cited by examiner

*Primary Examiner*—Tulsidas Patel
*Assistant Examiner*—Chandrika Prasad
(74) *Attorney, Agent, or Firm*—Banner & Witcoff, Ltd.

(57) ABSTRACT

A waterproof connector is provided with a moving support plate without requiring an increase in size of the connector. A moving plate (40) has a shape whereby a side wall (42) protrudes upwards from circumference edges of a base plate (41) having maintaining holes (44) adapted to receive tabs (24) of male terminal fittings. This moving plate (40) can be inserted in a movable manner within a hood (22) of male housing (20). A first sealing ring (51), for sealing the space between the moving plate (40) and an outer circumference face of the female housing (10), is formed on an attachment base of an inner circumference face of an anterior end (42A) of the side wall (42). A second sealing ring (52), for sealing the space between the moving plate (40) and in inner circumference face of the posterior end (42B) of the side wall (42). These sealing rings (51) and (52) are formed in a unified manner, by means of two-component molding, on the moving plate (40).

12 Claims, 5 Drawing Sheets

CONNECTOR WITH TERMINAL PROTECTIVE PLATE HAVING INTERNAL AND EXTERNAL SEALING MEMBERS

TECHNICAL FIELD

The present invention relates to an electrical connector provided with a moving plate.

BACKGROUND TO THE INVENTION

One example of a connector provided with a moving plate is described in JP 11-204184. This connector correctly aligns tabs of male terminal fittings housed within a hood of a male housing, and prevents an external force from being exerted on these tabs. The moving plate has maintaining holes through which the tabs of the male terminal fittings pass. The moving plate is inserted into the hood in a manner whereby it can move along the fitting direction of male and female housings, the moving plate first being attached to an opening end of the hood in a location whereby the maintaining holes are in the vicinity of tips of the tabs. While the female housing is being fitted into the hood of the male housing, the moving plate moves inwards relative to the hood, the tabs enter the maintaining holes, and corresponding male and female terminal fittings make mutual contact.

In the case where this type of connector needs to be waterproofed, a sealing ring is usually attached between an inner circumference face of the opening end of the hood of the male housing and an outer circumference face (this being located opposite the above-mentioned inner circumference face) of the female housing.

If the sealing ring is attached to the outer circumference face of the female housing, the sealing ring is exposed when the female housing has not yet been attached. Consequently, it is necessary to provide a protecting wall to surround and thereby protect the sealing ring. This increases the diameter of the connector. Conversely, if the sealing ring is attached to the inner circumference face of the opening end of the hood of the male housing, the anterior end of the hood must be extended in order to prevent the sealing ring from interfering with the moving plate that is attached within the hood. As a result, the size of the connector increases in an axial direction. That is, in the conventional case, if a connector provided with a moving plate is to be waterproofed, the size of the connector will invariably increase.

The present invention has taken the above problem into consideration, and aims to present a means for waterproofing a connector provided with a moving plate without requiring an increase in size of the connector.

SUMMARY OF THE INVENTION

According to the invention there is provided a connector comprising a male housing having a hood, and a female housing insertable in a fitting direction into said hood to a fully fitted condition, said first housing having terminals protruding in the hood in the fitting direction, and a plate in the hood, said plate being generally perpendicular to the fitting direction, having apertures to receive said terminals, and being movable in the hood in the fitting direction along said terminals, characterized in that said plate is provided with an external sealing member for an inner circumferential face of said hood, and an internal sealing member for an outer circumferential face of said female housing.

Such a construction avoids the need for enlargement of the connector to accommodate sealing rings.

Preferably the mouth of the first housing is stepped inwardly at the innermost region of the hood so as to provide a sealing surface for the external sealing member whilst avoiding excessive friction as the plate moves towards the fully fitted condition.

The inner and outer sealing members preferably overlap in the direction perpendicular to the fitting direction—this arrangement minimizes the size of the plate, and consequently the hood.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENTS

An embodiment of the present invention is described below with the aid of FIGS. 1 to 10.

Figure 1:
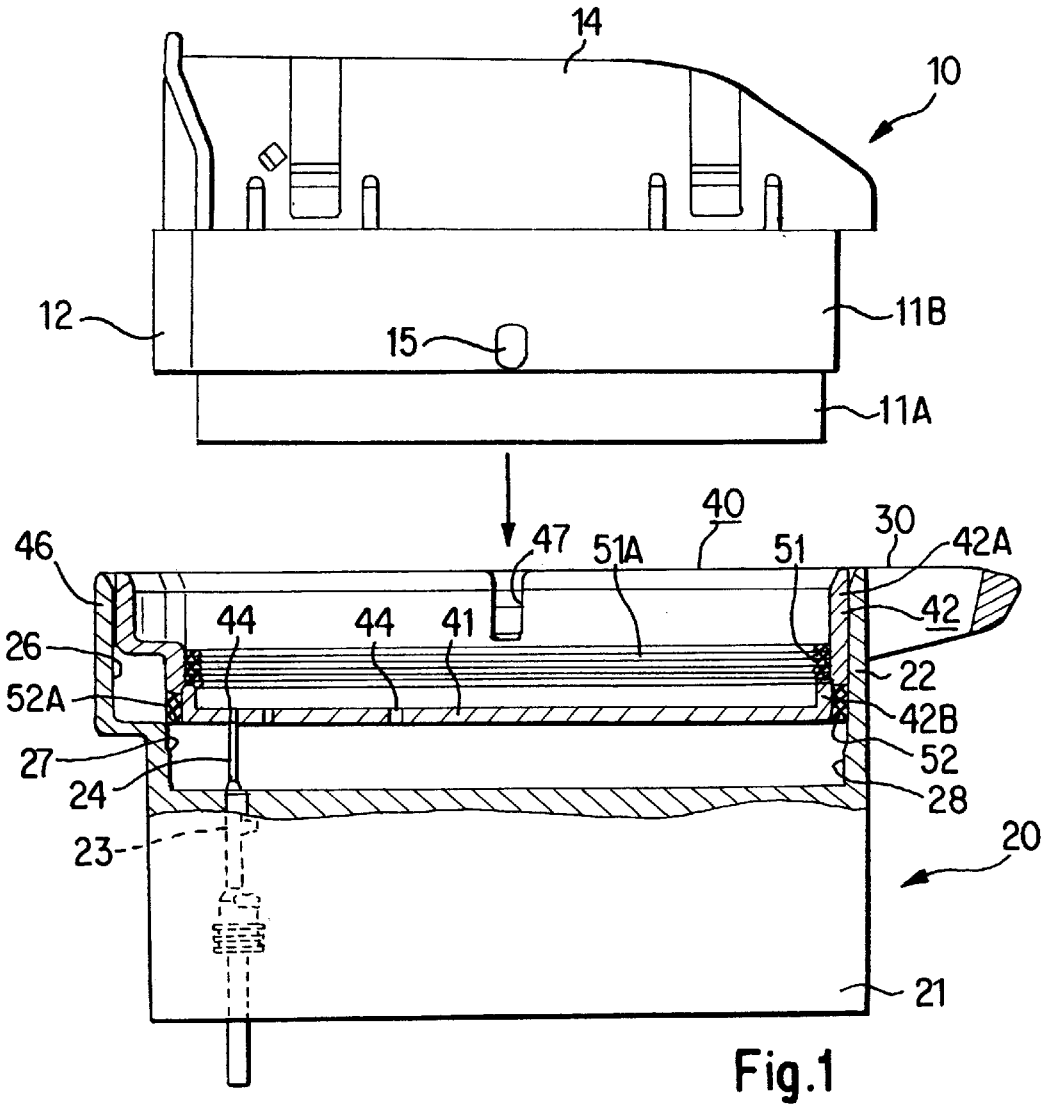
FIG. 1 is a partially cut-away side face view showing male and female housings of an embodiment of the present invention in a state prior to their being fitted together.

As shown in FIG. 1, a connector of the present embodiment is provided with a female connector housing 10 and a male connector housing 20. A moving plate 40 is provided in the male housing 20, and a lever 30 is used to perform a fitting operation of the two housings 10 and 20.

The fitting face sides of the female and male housings 10 and 20 will hereafter be considered as the anterior sides.

Figure 2:
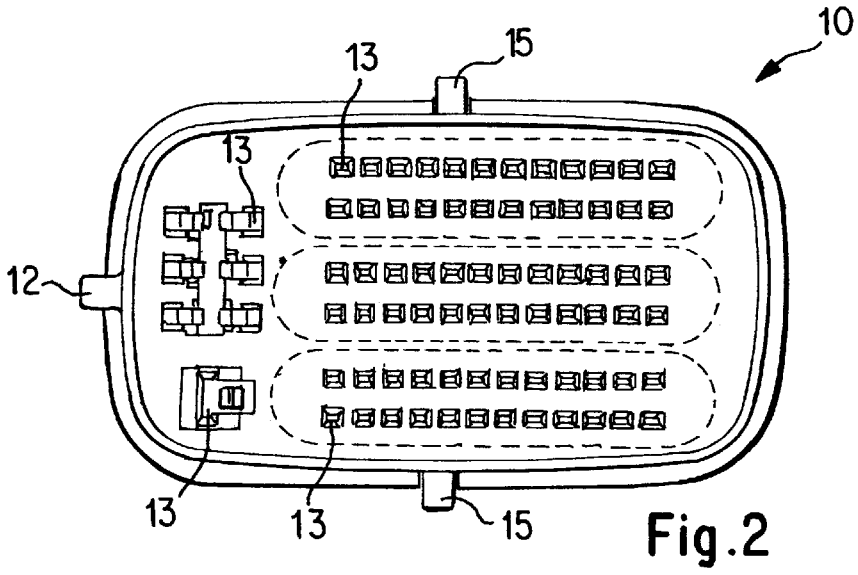
FIG. 2 is a front view of the female housing.

As shown also in FIG. 2, the female housing 10 is formed from plastic and has an approximately rectangular parallelopiped shape. An anterior edge 11A thereof is formed in a smaller step shape, and a guiding rib 12 protrudes from a shorter side face of a posterior edge 11B. A plurality of cavities are formed within the female housing 10, these forming aligned terminal fitting insertion holes 13 that are open to the fitting face. Female terminal fittings (not shown) can be housed from the posterior within these cavities. A cover 14 is attached to a posterior face of the female housing 10, this cover 14 covering electric wires that make contact the female terminal fittings and being removable in one direction (to the left in FIG. 1). Follower pins 15 protruded from central portions of both longer side faces of the posterior edge 11B.

Figure 3:
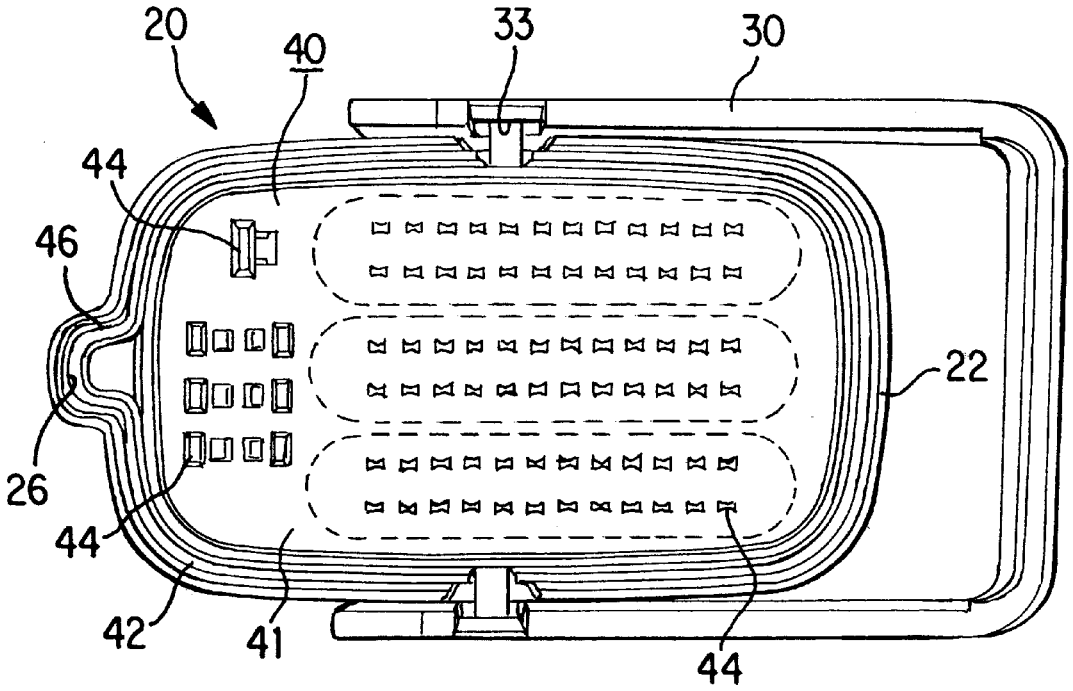
FIG. 3 is a front view of the male housing.
Figure 4:
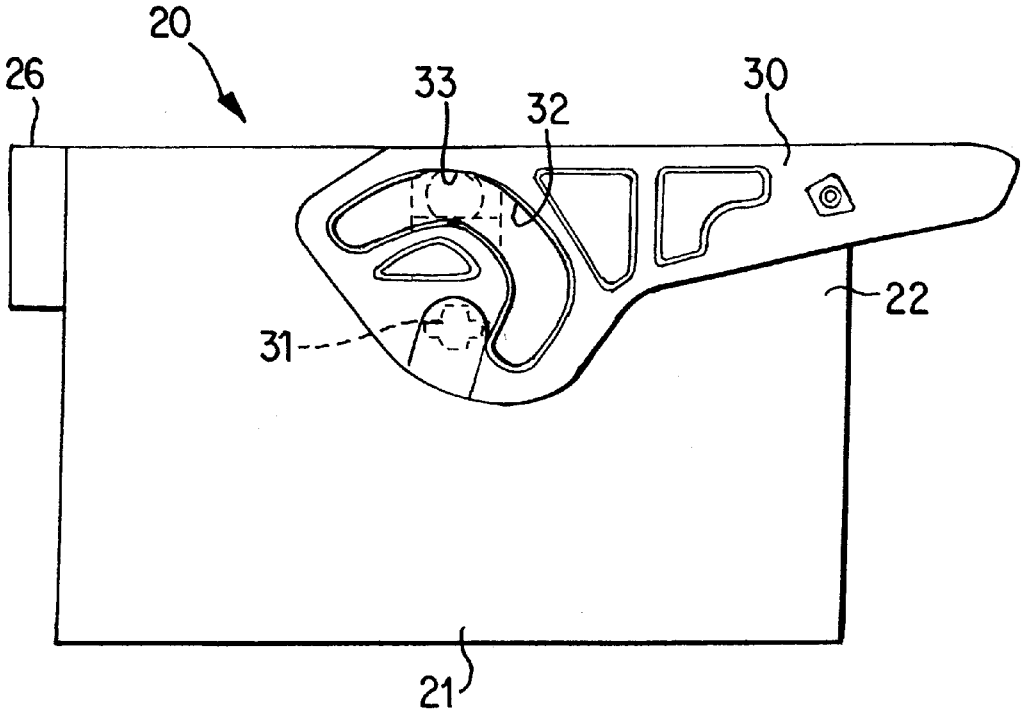
FIG. 4 is a side face view of the male housing.

The male housing 20 is also made from plastic. As shown in FIGS. 3 and 4, a hood 22, into which the female housing 10 fits, is formed at an anterior face side of a main body 21 of the male housing 20, cavities being formed within this main body 21. Male terminal fittings 23 (FIG. 6) can be inserted from the posterior into these cavities, tabs 24 at tips of these male terminal fittings 23 being housed within the hood 22 in a manner whereby these tabs 24 protrude for a specified length therein. An outwardly protruding guiding groove 26 is formed at an anterior end portion of one of the narrow side faces of the hood 22, this guiding groove 26 being open towards the anterior. As shown in detail in FIG. 9, a reduced diameter face 28 is formed along a portion of an innermost side (this having a specified width) of an inner circumference face of the hood 22, this reduced diameter face 28 protruding inwards at the location of a tapered face 27.

A forked lever 30 is attached to the male housing 20. This lever 30 straddles the male housing 20, axles 31 thereof serving as its centre. The lever 30 can be pivoted between a beginning position (see FIG. 1) and an end position (see FIG. 8). Cam grooves 32, these having a specified shape, are provided in the lever 30, the follower pins 15 fitting therein.

Figure 5:
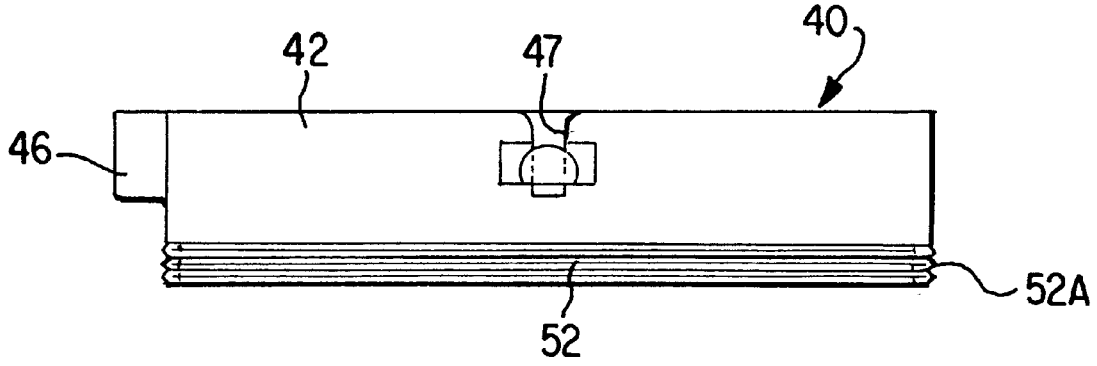
FIG. 5 is a side face view of a moving plate.

The moving plate 40 is also made from plastic. As also shown in FIG. 5, a side wall 42 surrounds the circumference of a base plate 41, this side wall 42 facing towards the anterior. A posterior end 42B (FIG. 1), located at the side of the side wall 42 that is closer to the base plate 41, has a smaller circumference. Maintaining holes 44 are formed in the base plate 41, the tabs 24 of the male terminal fittings 23 attached to the male housing 20 fitting tightly into these maintaining holes 44. These maintaining holes 44 are formed at locations corresponding to the locations where the tabs 24 protrude.

The moving plate 40 fits with the female housing 10 and male housing 20. An outer circumference face of an anterior end 42A (this being a portion of the side wall 42 having the larger circumference) fits tightly within the hood 22 of the male housing 20. An outer circumference face of the posterior edge 11B of the female housing 10 fits tightly into an inner side of the anterior end 42A of the side wall 42.

A guide 46 is formed at an opening end face of one of the narrower sides of the anterior end 42A of the side wall 42. This guide 46 is smaller in circumference than the guiding groove 26 of the male housing 20 and is capable of fitting therein. The guiding rib 12 of the female housing 10 fits into the guide 46. An outer circumference face of the anterior edge 11A (this having a smaller circumference than 11B) of the female housing 10 fits tightly into an inner circumference face of the posterior end 42B (this having a smaller circumference than 42A) of the side wall 42.

Figure 9:
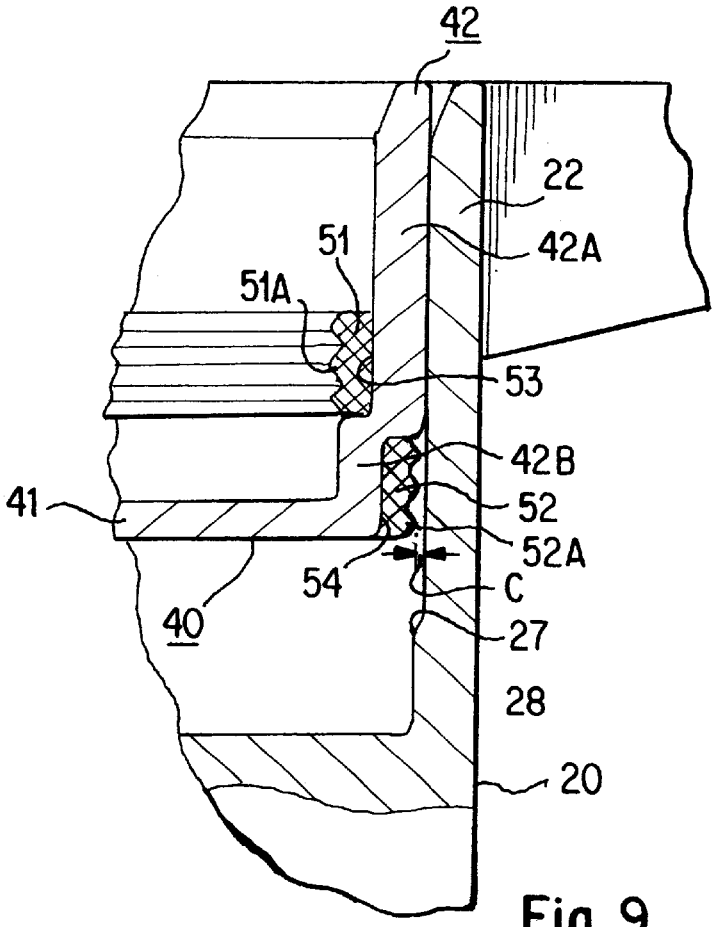
FIG. 9 is a partially enlarged cross-sectional view showing the housings prior to the fitting operation.

A first sealing ring 51, for sealing the space between the female housing 10 and the moving plate 40, is formed at an attachment base 53 at an inner circumference face of the anterior end 42A of the side wall 42 of the moving plate 40. Three lips 51 A are formed on an outer circumference face of the first sealing ring 51. As shown in FIG. 9, tips of these lips 51A protrude inwards relative to the inner circumference face of the posterior end 42B of the side wall 42.

A second sealing ring 52 extends along the entire length of an outer circumference face 54 of the posterior end 42B of the side wall 42 of the moving plate 40, this second sealing ring 52 sealing the space between the moving plate 40 and the hood 22 of the male housing 20. Three lips 52A are formed on an outer circumference face of the second sealing ring 52. Tips of these lips 52A protrude to the vicinity of the inner circumference face of the anterior end 42A of the side wall 42. As will be explained later, when the moving plate 40 starts to be pushed to a correct position, the lips 52A of the second sealing ring 52 are compressed against the reduced diameter face 28 at the inner circumference face of the hood 22 of the male housing 20. As a result, a clearance C is present to the anterior side of the reduced diameter face 28, between the lips 52A of the second sealing ring 52 and the inner circumference face of the hood 22 (see FIG. 9).

The first and second sealing rings 51 and 52 are formed in a unified manner with the moving plate 40 by means of two-component moulding. For example a two-component injection moulding machine may be used to mould two differing materials into one moulded object, the moving plate 40 being formed from hard plastic and the first and second sealing rings 51 and 52 being formed from elastomer.

Recessed grooves 47 (FIG. 5) are formed by cutting away opening edges of inner faces of longer sides of the side wall 42 of the moving plate 40. The follower pins 15 of the female housing 10 fit into these recessed grooves 47.

Next, the operation of the present embodiment will be described. After the male terminal fittings 23 have been housed within the male housing 20, the guide 46 is fitted into the guiding groove 26 and the moving plate 40 is attached so that it forms a unified face with an opening edge of the hood 22 (see FIG. 1). Then the tips of the tabs 24 of the male terminal fittings 23 (these tips protruding into the hood 22) are fitted into the maintaining holes 44 formed in the base plate 41 of the moving plate 40. This protects the tips of the tabs 24 when the male housing 20 is still in an unattached state. Even if foreign objects enter the male housing 20, the moving plate 40 prevents the tips of tabs 24 from being bent, and ensures that they remain aligned. The lever 30 is maintained in the beginning position.

After the female terminal fittings have been housed within the female housing 10, the cover 14 is attached to the posterior face of this female housing 10. Then the guiding rib 12 is fitted into the guide 46, and the female housing 10 is fitted, in the direction shown by the arrow in FIG. 1, into the hood 22 of the male housing 20, towards the moving plate 40.

Figure 6:
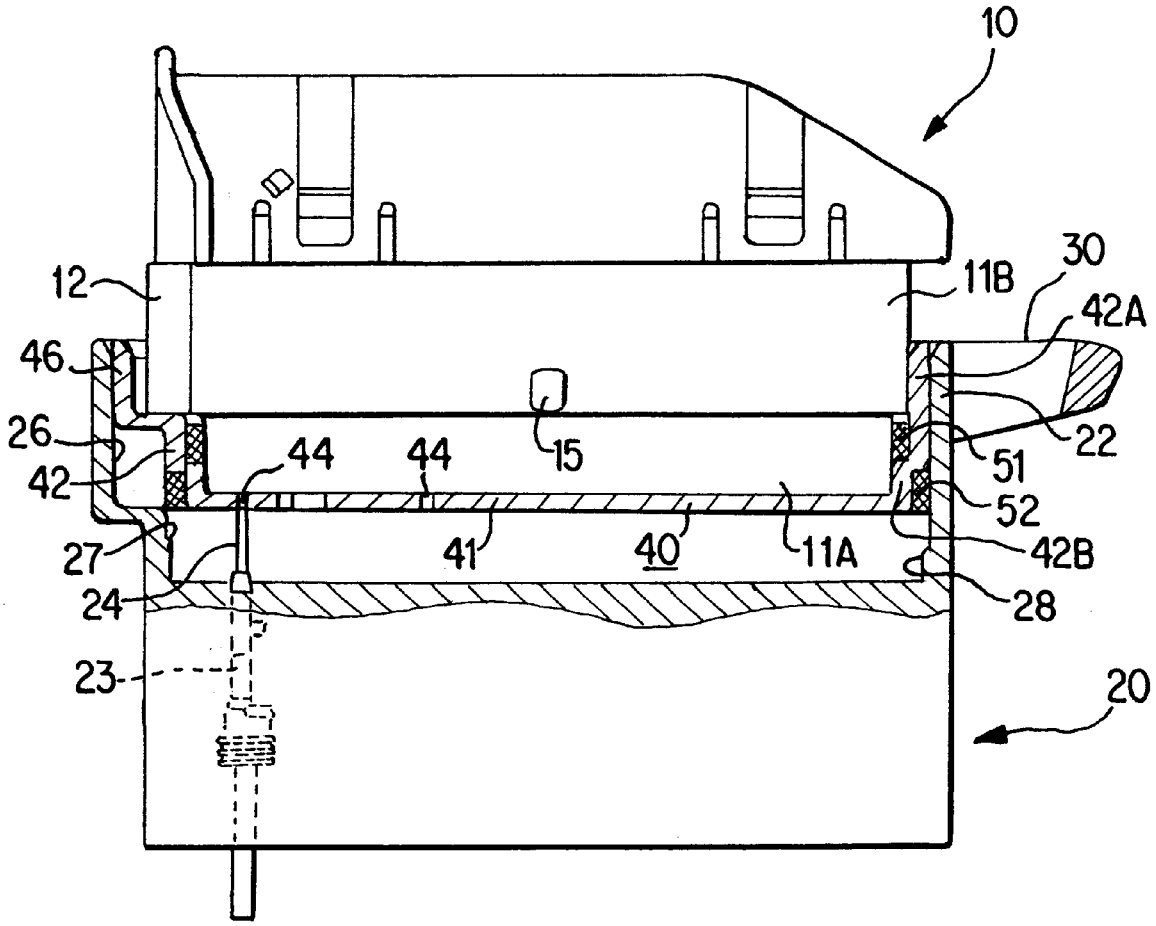
FIG. 6 is a partially cut-away side face view showing the male and female housings as the fitting operation thereof begins.

Next, as shown in FIG. 6, the female housing 10 is fitted until the fitting face thereof makes contact with the base plate 41 of the moving plate 40. As a result, the tips of the tabs 24 of the male terminal fittings 23 adjacent to the maintaining holes 44 of the moving plate 40 reach a state whereby they are directly opposite the terminal fitting insertion holes 13 of the female housing 10. The first sealing ring 51 is in a state whereby it is compressed between the outer circumference face of the anterior edge 11A of the female housing 10 and the inner circumference face of the anterior end 42A of the side wall 42 of the moving plate 40.

Simultaneously, the follower pins 15 of the female housing 10 are fitted into openings 33 of the cam grooves 32 of the lever 30 attached to the male housing 20.

Figure 7:
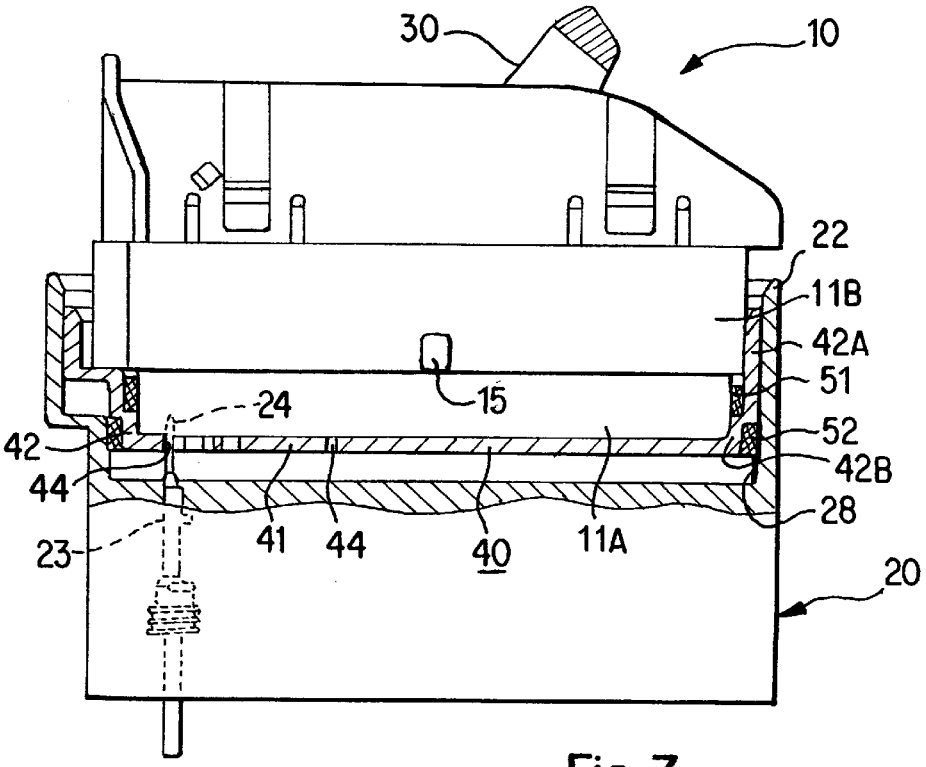
FIG. 7 is a partially cut-away side face view showing the male and female housings being fitted together.

Next, as shown in FIG. 7, the lever 30 is pivoted towards the end position, and the cam operation of the cam grooves 32 and the follower pins 15 causes the female housing 10 to approach the moving plate 40 and the innermost portion of the hood 22. The tabs 24 of the male terminal fittings 23 are located directly opposite the corresponding terminal fitting insertion holes 13, and they are being maintained in a straight state by the maintaining holes 44. As a result, they smoothly enter the terminal fitting insertion holes 13 and gradually make contact with the corresponding female terminal fittings.

While this fitting is occurring, the lips 52A of the second sealing ring 52 are compressed by the tapered face 27 and gradually rise over the reduced diameter face 28.

Figure 8:
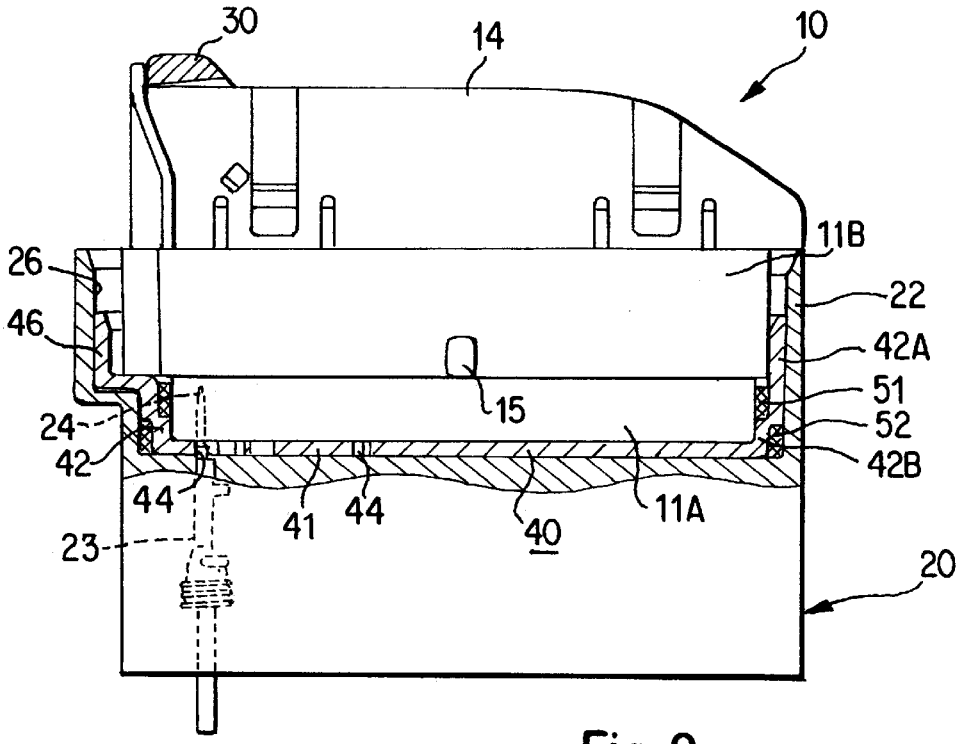
FIG. 8 is a partially cut-away side face view showing the male and female housings after the fitting operation thereof has been completed.

As shown in FIG. 8, the base plate 41 makes contact with the innermost face of the hood 22 when the lever 30 is pivoted to the end position, and the fitting operation is completed, each male terminal fitting 23 correctly making contact with the corresponding female terminal fittings. Moreover, the second sealing ring 52 provided on the outer circumference face 54 of the posterior end 42B of the side wall 42 of the moving plate 40 seals the space between the moving plate 40 and the reduced diameter face 28 at the innermost portion of the inner circumference face of the hood 22.

Figure 10:
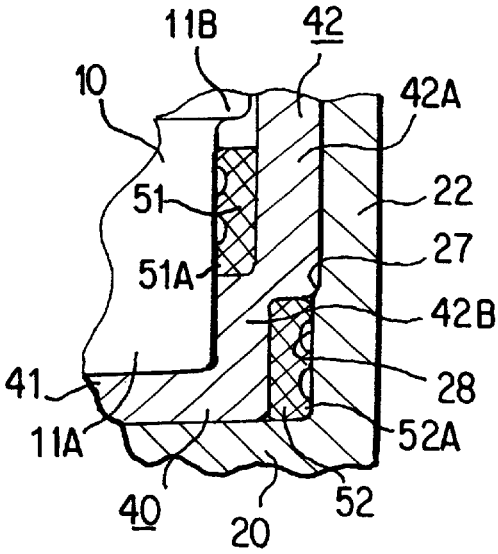
FIG. 10 is a partially enlarged cross-sectional view showing the housings after the fitting operation has been completed.

That is, the first sealing ring 51 formed on the moving plate 40 seals the space between the inner circumference face of the side wall 42 of the moving plate 40 and the outer circumference face of the female housing 10, and the second sealing ring 52 seals the space between the outer circumference face of the side wall 42 and the inner circumference face of the hood 22 (this is shown in detail in FIG. 10). As a result, the space between the female and male housings 10 and 20 is sealed, and the contacting portions of the terminal fittings are waterproofed.

In the present embodiment, the sealing rings 51 and 52 are formed in a unified manner on the moving plate 40. Consequently, there is no need to provide a separate hood to protect the sealing ring, as in the conventional case when the sealing ring is attached to the outer circumference of the female housing. Nor does one need to extend the anterior end of the hood in order to prevent the sealing ring from interfering with the moving plate, as in the conventional case when the sealing ring is attached to the inner circumference of the male housing. That is, the connector can be waterproofed reliably without this having to increase the size thereof. The sealing rings 51 and 52 are formed in a unified manner with the moving plate 40 by means of two-component moulding. Consequently, the sealing rings are provided on the moving plate 40 by means of a simple process.

The inner circumference face of the hood 22 has the reduced diameter face 28 provided only at the innermost portion thereof. As a result, the second sealing ring 52 is compressed so as to rise over this reduced diameter face 28 only when the final stage of fitting begins, thereby eliminating excessive frictional resistance during fitting. This allows the fitting to take place with a small fitting force.

In order to provide the second sealing ring 52 (which seals the space between the hood 22 and the moving plate 40) on the moving plate 40, the posterior end 42B of the side wall 42 (this being separated from the location of the first sealing ring 51 in the axial direction) is reduced in diameter. Since the second sealing ring 52 is provided on the outer circumference face 54 that has a reduced diameter, the diameter of the moving plate 40, including the second sealing ring 52, can be reduced in size. This means that the hood 22 of the male housing 20, into which this moving plate 40 is fitted, can be reduced in size in the direction of the diameter. As a result, the entire connector can be reduced in size.

The present invention is not limited to the embodiments described above with the aid of figures. For example, the possibilities described below also lie within the technical range of the present invention. In addition, the present invention may be embodied in various other ways without deviating from the scope thereof.

Figure 11:
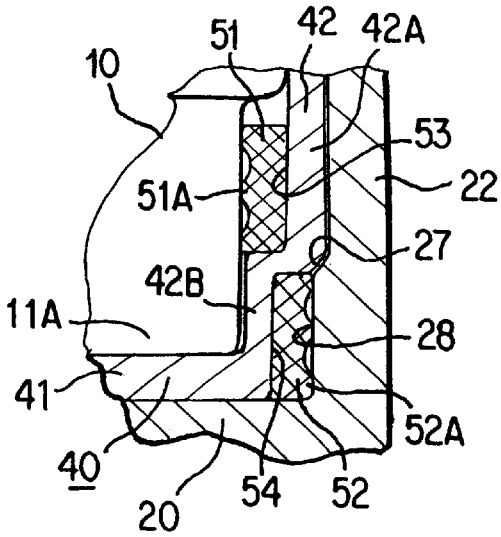
FIG. 11 is a partially enlarged cross-sectional view showing the housings of another embodiment after the fitting operation has been completed.

(1) As shown in FIG. 11, the posterior end 42B of the side wall 42 of the moving plate 40, on which the second sealing ring 52 is provided, may be further reduced in diameter. If the second sealing ring 52 is positioned such that an inner circumference thereof overlaps with an outer circumference of the first sealing ring 51, that is, if the inner diameter of the second sealing ring 52 is less than the outer diameter of the first sealing ring 51, the second sealing ring 52 retreats further in the direction of the diameter, and the connector can be miniaturized further.

(2) The means to provide the sealing rings on the moving plate need not be limited to the two-component moulding of the present embodiment. The sealing rings may be formed in a unified manner by insert moulding, or they may be formed as separate components and then attached by means of welding, adhesive, etc.

(3) The present invention is equally suitable for a connector provided with a moving plate that does not use a lever.

What is claimed is:

1. A connector comprising a male housing having a hood, and a female housing having an outer circumference face and insertable in a fitting direction into said hood to a fully fitted condition, said male housing having terminals protruding in said hood in the fitting direction, and a plate in said hood, said plate being generally perpendicular to the fitting direction, having apertures to receive said terminals, and being movable in said hood in the fitting direction along said terminals, wherein said plate is provided with an external sealing member for an inner circumferential face of said hood, and an internal sealing member for an outer circumferential face of said female housing.

2. A connector according to claim 1 wherein said hood is stepped inwardly to reduce the internal circumference thereof in the region furthest from the mouth of said hood, said external sealing member engaging said region in the fully fitted condition, and being compressed by said region.

3. A connector according to claim 2 wherein the mouth of said region has a ramp to facilitate smooth engagement of said external sealing member.

4. A connector according to claim 1 wherein said external sealing member and internal sealing member are distanced in the fitting direction, the external sealing member being inwardmost of said hood.

5. A connector according to claim 4 wherein an inner diameter of said external sealing member is less than an outer diameter of said internal sealing member.

6. A connector according to claim 1 wherein said plate comprises a dish having a base generally perpendicular to the fitting direction, and a continuous peripheral wall facing outwardly of said hood.

7. A connector according to claim 6 wherein said hood and said continuous peripheral wall are indented outwardly to provide a complementary discontinuity.

8. A connector according to claim 6 wherein said hood has two open channels in the wall thereof and facing in the fitting direction, said channels being opposite and being adapted to receive opposite protrusions of said second housing.

9. A connector according to claim 7 wherein said plate has two open channels in the wall thereof and facing in the fitting direction, said channels being opposite and being adapted to receive opposite protrusions of said second housing.

10. A connector according to claim 1 wherein said external and internal sealing members have circumferential lips for respective contact with said hood and female housing.

11. A connector according to claim 1 wherein said external and internal sealing members are resilient, and said plate is relatively rigid, said sealing members and plate being co-moulded in a unified manner by the two component moulding method.

12. A connector comprising a male housing having a hood, and a female housing having an outer circumference face and insertable in a fitting direction into said hood to a fully fitted condition, said male housing having terminals protruding in said hood in the fitting direction, and a plate in said hood, said plate being generally perpendicular to the fitting direction, having apertures to receive said terminals, and being movable in said hood in the fitting direction along said terminals, wherein said plate is provided with an external sealing member for an inner circumferential face of said hood, and an internal sealing member for an outer circumferential face of said female housing, said plate being relatively rigid, said external sealing member and said internal sealing member being relatively resilient, and said external sealing member, said internal sealing member and said plate being co-moulded in a unified manner.

* * * * *

UNITED STATES PATENT AND TRADEMARK OFFICE

CERTIFICATE OF CORRECTION

PATENT NO. : 6,464,522 B2
DATED : October 15, 2002
INVENTOR(S) : Hiroki Osawa et al.

It is certified that error appears in the above-identified patent and that said Letters Patent is hereby corrected as shown below:

Title page,
Item [57], ABSTRACT,
Line 13, replace "in" with -- an --.
Line 14, insert -- of the hood 22 of the male housing 20, is formed on an outer circumference face -- before "of the posterior end".

Signed and Sealed this

Eleventh Day of February, 2003

JAMES E. ROGAN
*Director of the United States Patent and Trademark Office*